US010895117B2

(12) United States Patent
Al-Qasim et al.

(10) Patent No.: US 10,895,117 B2
(45) Date of Patent: Jan. 19, 2021

(54) SYSTEMS AND METHODS FOR IMPROVED CENTRALIZATION AND FRICTION REDUCTION USING CASING RODS

(71) Applicant: Saudi Arabian Oil Company, Dhahran (SA)

(72) Inventors: Abdulaziz Al-Qasim, Dhahran (SA); Muataz Al-Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 73 days.

(21) Appl. No.: 16/235,362

(22) Filed: Dec. 28, 2018

(65) Prior Publication Data

US 2020/0208474 A1 Jul. 2, 2020

(51) Int. Cl.

| | |
|---|---|
| ***E21B 17/10*** | (2006.01) |
| ***E21B 33/14*** | (2006.01) |
| ***E21B 17/02*** | (2006.01) |
| ***E21B 19/24*** | (2006.01) |

(52) U.S. Cl.

CPC ..... *E21B 17/1057* (2013.01); *E21B 17/1014* (2013.01); *E21B 33/14* (2013.01)

(58) Field of Classification Search

CPC .. E21B 17/1014; E21B 33/14; E21B 17/1057; E21B 17/026; E21B 17/10; E21B 17/1085; E21B 17/1078

See application file for complete search history.

(56) References Cited

U.S. PATENT DOCUMENTS

| | | | |
|---|---|---|---|
| 3,063,759 | A | 11/1962 | Moore et al. |
| 3,320,004 | A | 5/1967 | Garrett |
| 5,261,488 | A | 11/1993 | Gullet et al. |
| 6,585,043 | B1 | 7/2003 | Murray |
| 7,086,479 | B2 | 8/2006 | Schultz et al. |
| 8,752,638 | B2 | 6/2014 | Nutley et al. |
| 2002/0020526 | A1 | 2/2002 | Male et al. |
| 2003/0159834 | A1 | 8/2003 | Kirk et al. |
| 2005/0224123 | A1 | 10/2005 | Baynham et al. |
| 2007/0215388 | A1 | 9/2007 | Kirk et al. |
| 2010/0276138 | A1 | 11/2010 | Wittman et al. |
| 2013/0319684 | A1 | 12/2013 | Moellendick |

FOREIGN PATENT DOCUMENTS

| | | | |
|---|---|---|---|
| CN | 200943451 | Y | 9/2007 |
| CN | 201635674 | U | 11/2010 |
| CN | 202157757 | U | 3/2012 |
| CN | 205743753 | U | 11/2016 |
| RU | 2260667 | C1 | 9/2005 |
| WO | 2009047536 | A1 | 4/2009 |
| WO | 2015143564 | A1 | 10/2015 |
| WO | 2017015727 | A | 2/2017 |

OTHER PUBLICATIONS

International Search Report and Written Opinion for related PCT application PCT/US2019/068523 dated Apr. 22, 2020. (SA5978PCT).

*Primary Examiner* — Giovanna Wright
*Assistant Examiner* — Manuel C Portocarrero
(74) *Attorney, Agent, or Firm* — Bracewell LLP; Constance G. Rhebergen; Linda L. Morgan

(57) ABSTRACT

System and methods for completing a subterranean well include a casing string, the casing string being an elongated tubular member formed of successive casing joints and having a central axis. A plurality of ribs are secured to the casing string, the ribs being elongated members spaced circumferentially around an outer diameter of the casing string. The ribs extend axially from a downhole end of a casing joint to an uphole end of the casing joint.

16 Claims, 4 Drawing Sheets

SYSTEMS AND METHODS FOR IMPROVED CENTRALIZATION AND FRICTION REDUCTION USING CASING RODS

BACKGROUND OF THE INVENTION

1. Field of the Invention

The present invention relates generally to casing for use in subterranean wells, and more specifically to the centralization of casing within a subterranean well.

2. Description of the Related Art

When a subterranean well, such as a well used in hydrocarbon development, is drilled the subterranean well can be completed with tubulars or casings. The casing can be positioned within an open hole portion of the well and cemented in place. Casing that is centered within the wellbore can allow for an optimal cementing operation. A poorly executed cementing operation can result in the need for a high cost remedial operation and can damage the life of the well.

SUMMARY OF THE DISCLOSURE

Embodiments of this disclosure provide systems and methods for centralizing the casing with the wellbore before cementing operations begin. With the development of extended reach and more complex geometry wells, performing a cement job that provides the desired zonal isolation with a sufficient cement bond and integrity has become a challenge, especially in horizontal wells. In addition, running casing to bottom of hole can be difficult in wells that are deviated or suffer from wellbore irregularities such as tight holes or washouts, which when coupled with difficult well trajectory can lead to problems such as stuck casing.

By centralizing the casing and reducing the friction between the casing and the wellbore with bearings, casing can be more effectively run into a well while maintaining an optimal casing standoff for performing an improved cementing operation. The use of long and robust rods will greatly improve the casing standoff over the entire length of the casing, compared to current centralization tools that only provide limited zonal centralization at the interval where such tools are placed.

In an embodiment of this disclosure, a system for completing a subterranean well includes a casing string, the casing string being an elongated tubular member formed of successive casing joints and having a central axis. A plurality of ribs are secured to the casing string. The ribs are elongated members spaced circumferentially around an outer diameter of the casing string. The ribs extend axially from a downhole end of a casing joint to an uphole end of the casing joint.

In alternate embodiments, each of the plurality of ribs can include a rod member and bearings located around a portion of the outer diameter of the rod member. The rod member can be welded directly to the outer diameter of the casing string. Each of the plurality of ribs can include a wing member secured to the casing joint and extending radially outward, and the rod member can be located at a radially outward end of the wing member. The ribs can include an elastic material.

In other alternate embodiments, each of the plurality of ribs can be moveable between a retracted position and an extended position. In the retracted position a radially outermost surface of the rib can have a retracted diameter measured from the central axis that is substantially equal to an outer diameter of the casing joint. In the extended position the radially outermost surface of the rib can have an extended diameter measured from the central axis that is greater than the outer diameter of the casing joint. The ribs can include a swellable material.

In an alternate embodiment of the disclosure, a system for completing a subterranean well includes a casing string, the casing string being an elongated tubular member formed of successive casing joints and having a central axis. The casing string extends into the subterranean well. A plurality of ribs are secured to the casing string, the ribs being elongated members spaced circumferentially around an outer diameter of the casing string. The ribs extend axially from a downhole end of a casing joint to an uphole end of the casing joint. The ribs are positionable radially outward from the casing string to center the casing string within the subterranean well.

In alternate embodiments, each of the plurality of ribs can include a rod member and bearings located around a portion of the outer diameter of the rod member. Each of the plurality of ribs can include a wing member secured to the casing joint and extending radially outward, and a rod member located at a radially outward end of the wing member. The ribs can include an elastic material In other alternate embodiments, each of the plurality of ribs can be moveable between a retracted position and an extended position. In the retracted position a radially outermost surface of the rib can have a retracted diameter measured from the central axis that is substantially equal to an outer diameter of the casing joint. In the extended position the radially outermost surface of the rib can have an extended diameter measured from the central axis that is greater than the outer diameter of the casing joint. The ribs can include a swellable material.

In another alternate embodiment of this disclosure, a method for completing a subterranean well includes delivering a casing string into the subterranean well, the casing string being an elongated tubular member formed of successive casing joints and having a central axis. A plurality of ribs can be provided that are secured to the casing string. The ribs are elongated members spaced circumferentially around an outer diameter of the casing string. The ribs extend axially from a downhole end of a casing joint to an uphole end of the casing joint.

In alternate embodiments, each of the plurality of ribs can include a rod member and the method can further include locating bearings around a portion of the outer diameter of the rod member. The method can further include welding the rod member directly to the outer diameter of the casing string. Each of the plurality of ribs can include a wing member and the method can further include securing the wing member to the casing joint, where the rod member is located at a radially outward end of the wing member.

In other alternate embodiments, the method can further include moving each of the plurality of ribs between a retracted position and an extended position. In the retracted position a radially outermost surface of the rib can have a retracted diameter measured from the central axis that is substantially equal to an outer diameter of the casing joint. In the extended position the radially outermost surface of the rib can have an extended diameter measured from the central axis that is greater than the outer diameter of the casing joint.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
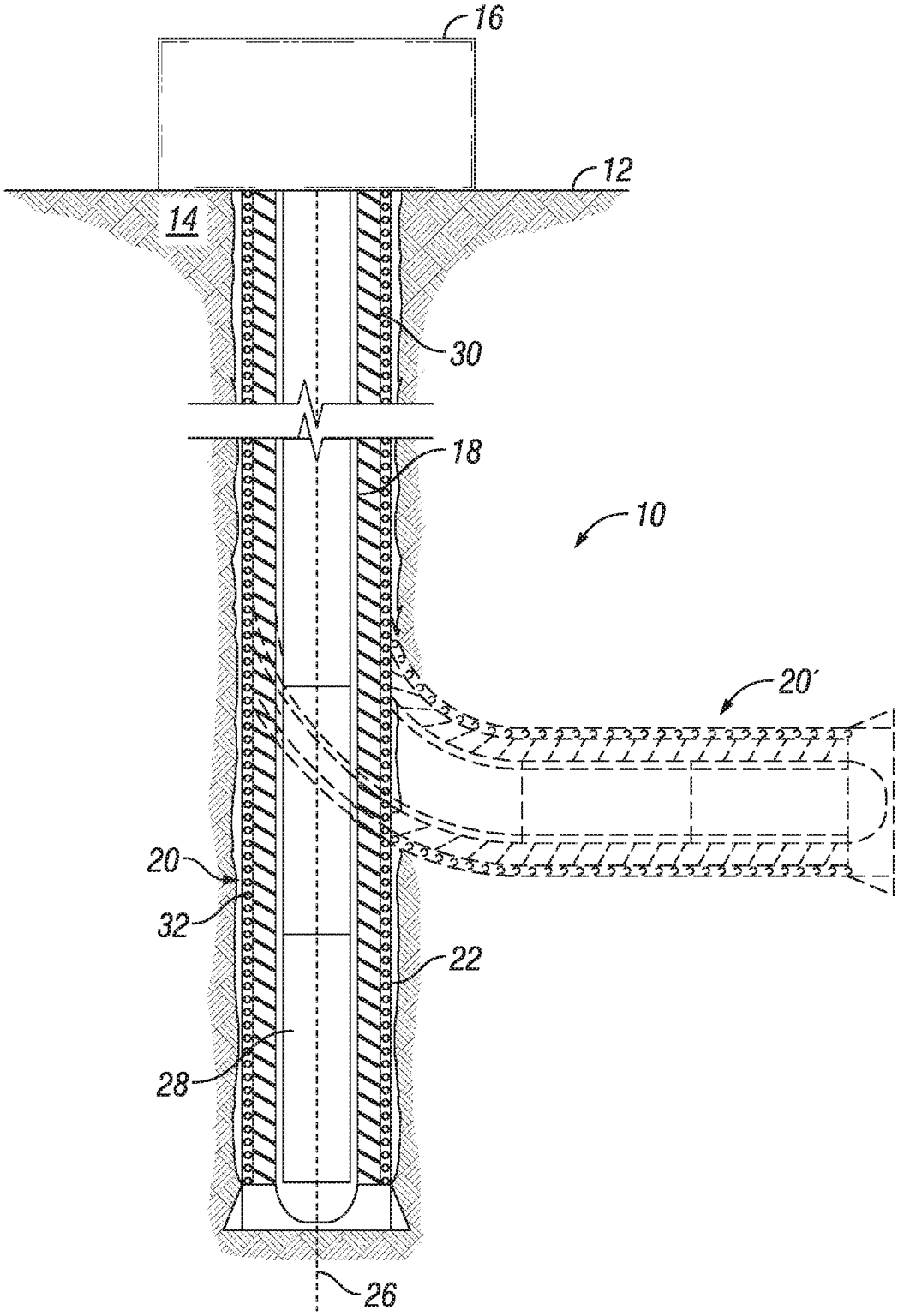
FIG. 1 is an elevation section view of a subterranean well having a casing string, in accordance with an embodiment of this disclosure.

Looking at FIG. 1, subterranean well 10 extends from a surface 12 into and through subterranean formation 14. Surface 12 can be, for example, an earth's surface or a sea bottom. Wellhead 16 is located as surface 12 at an uphole end of subterranean well 10. Casing string 18 extends within wellbore 20. Annular space 22 is defined between an outer diameter surface of casing string 18 and an inner surface of wellbore 20 of subterranean well 10.

Wellbore 20 of one example embodiment of FIG. 1 is a generally vertical wellbore 20. Wellbore 20 of an alternate example embodiment of FIG. 1 includes a portion that is a generally horizontal wellbore 20'. In other alternate embodiments, wellbore 20 can include portions that are generally vertical, portions that are generally horizontal, portions that are inclined at other angles from generally vertical, and can include combinations of one or more such portions.

Shown in FIG. 1 is a system for completing subterranean well 10. The system includes casing string 18. Casing string 18 is an elongated tubular member with central axis 26. Casing string 18 can be formed of successive casing joints 28. Casing string 18 extends into subterranean well 10 from surface 12 towards a downhole end of wellbore 20.

Figure 2:
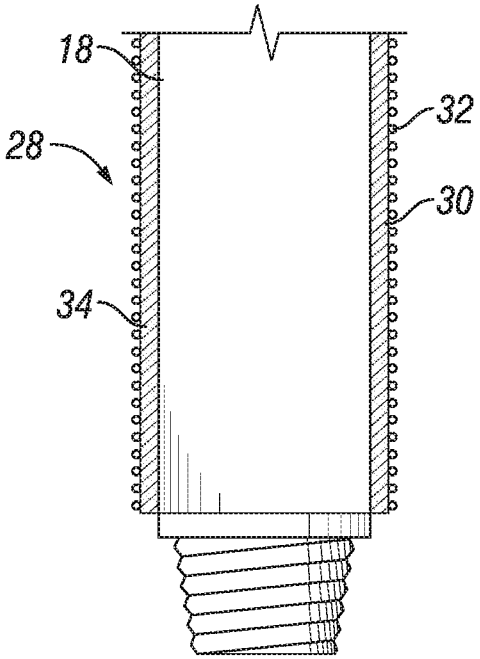
FIG. 2 is a section view of a portion of a casing joint, in accordance with an embodiment of this disclosure.
Figure 3:
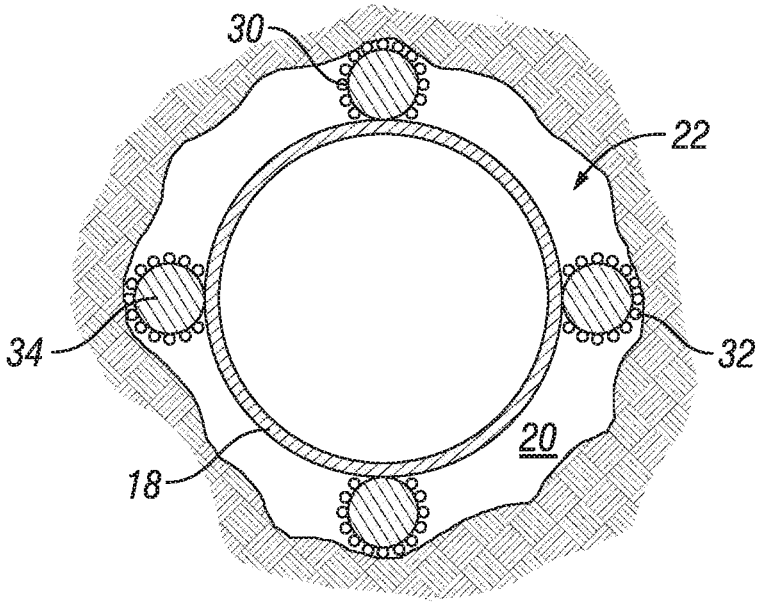
FIG. 3 is a cross section view of a casing joint of FIG. 2.
Figure 4:
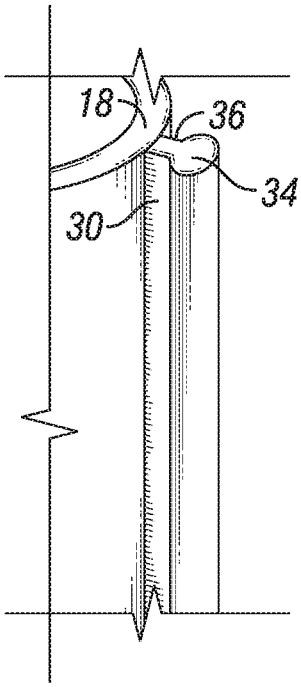
FIG. 4 is perspective view of a portion of a joint of casing, in accordance with an embodiment of this disclosure.
Figure 5:
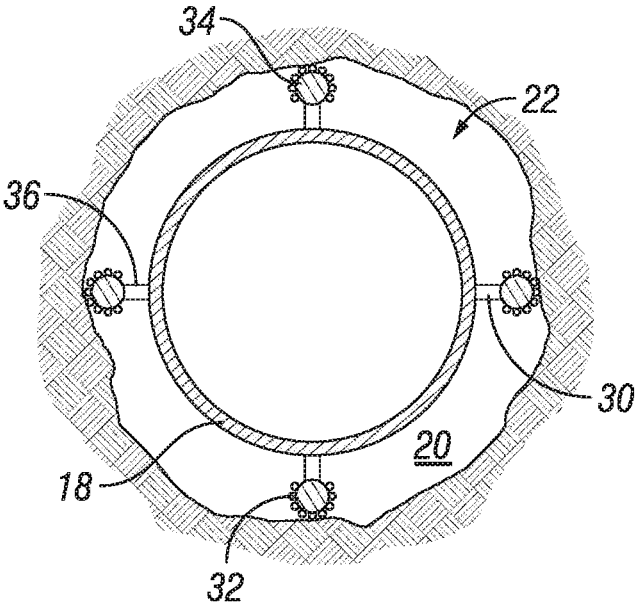
FIG. 5 is a cross section view of the joint of casing of FIG. 4.
Figure 6:
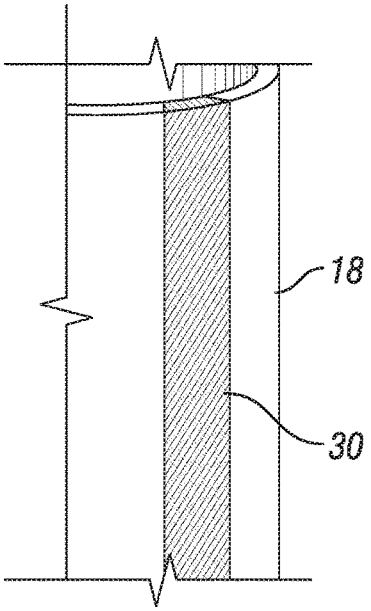
FIG. 6 is a perspective view of a portion of a joint of casing, in accordance with an embodiment of this disclosure.

Looking at FIGS. 2-3, ribs 30 are secured to casing string 18. Ribs 30 are spaced circumferentially around an outer diameter of casing string 18. Ribs 30 extend axially along the outer diameter of casing string 18 from a downhole end of each casing joint 28 to an uphole end of such casing joint 28. Ribs 30 are positionable to extend radially outward from casing string 18. In the example embodiments shown, four ribs 30 are secured to casing string 18. In alternate embodiments, there can be two, three, or more than four ribs 30. Ribs 30 can be secured directly to casing string 18. Ribs 30 can be secured to casing string 18, for example, by welding, by metallic stop collars, or by premium adhesive components.

Ribs 30 can act as centralizers to center casing string 18 within wellbore 20 of subterranean well 10, improving casing stand-off and eccentricity. One or more of the ribs 30 can contact the inner surface of wellbore 20 and the radially outward end of one or more of the ribs 30 can be spaced apart from the inner surface of wellbore 20. Because ribs 30 extend radially outward from casing string 18, ribs 30 can maintain a minimum distance between the outer diameter surface of casing string 18 and the inner surface of wellbore 20. Because ribs 30 extend from a downhole end of each casing joint 28 to an uphole end of such casing joint 28, ribs 30 can maintain a minimum distance between the outer diameter surface of casing string 18 and the inner surface of wellbore 20 along the entire length of casing string 18. This minimum distance, or stand-off, will provide for optimization of drilling fluid displacement and allow for cement that is injected in annular space 22 to completely surround casing string 18.

Ribs 30 can include an elastic material that has sufficient flexibility to pass through tight holes without breaking or completely deforming, and will return to the original shape of the rib after being partially deformed. As an example, ribs 30 can include a rubber that is resistant to deterioration from the fluids within wellbore 20 and has sufficient strength and durability to withstand the downhole pressures and forces.

In the example embodiment of FIGS. 2-3, each rib 30 has bearings 32 located around a portion of the outer diameter the rib 30. Bearings 32 are positioned to be directed towards the inner wall surface of wellbore 20. Bearings 32 can reduce the friction between casing string 18 and wellbore 20 during the process of running casing string 18 into wellbore 20. This can assist in ensuing that casing string 18 is successfully run into wellbore 20. Because ribs 30 protrude radially outward from casing string 18, ribs 30 will increase the friction between casing string 18 and wellbore 20 during the process of running casing string 18 into wellbore 20 and will cause additional drag compared to casing that does not include ribs 30. Bearings 32 can mitigate this increased friction and drag forces caused by the use of ribs 30.

Looking at FIGS. 2-5, ribs 30 can include rod member 34. Bearings 32 can be located around a portion of the outer diameter of rod member 34. Rod member 34 can be secured directly to the outer diameter of casing string 18 (FIGS. 2-3), such as by welding. Alternately, ribs 30 can include wing member 36 and rod member 34 can be located at radially outward end of wing member 36. Wing member 36 can be secured directly to the outer diameter of casing joint 28 of casing string 18 and extend radially outward from casing string 18. Both wing member 36 and rod member 34 can be formed of rubber.

Figure 7:
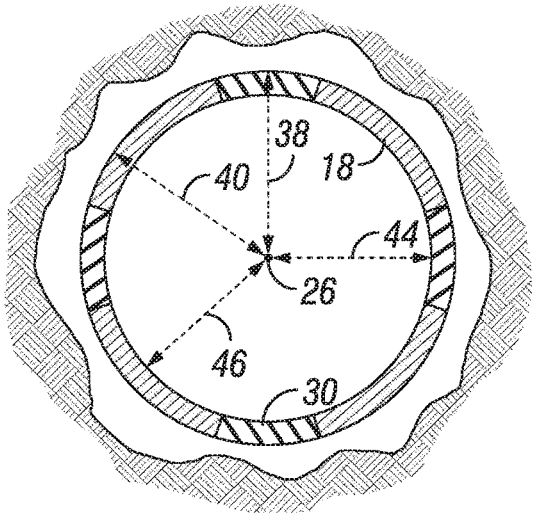
FIG. 7 is a cross section view of the joint of casing of FIG. 6, shown with the ribs in a retracted position.
Figure 8:
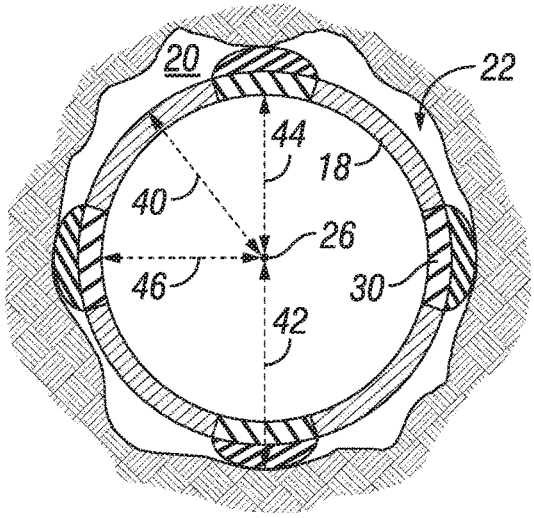
FIG. 8 is a cross section view of the joint of casing of FIG. 6, shown with the ribs in an extended position.

Rib 30 can further or alternately include a swellable material. The swellable material can be for example, a rubber. The swellable material can be selected to swell based on the fluid type expected to be in contact with rib 30. For example, if a water based mud is expected to be in contact with rib 30, the swellable material can be a water-swelling material. Alternately, if a oil based mud is expected to be in contact with rib 30, the swellable material can be an oil-swelling material. The swellable material can move from a retracted position (FIG. 7) to an extended position (FIG. 8) after reacting with a reaction agent, such as a mud or other fluid that is pumped into wellbore 20. When using the swellable material with rib 30, rib 30 is moveable between a retracted position and an extended position. In the retracted position a radially outermost surface of rib 30 has a retracted diameter 38 measured from central axis 26 that is substantially equal to a casing outer diameter 40 of casing joint 28. In the extended position the radially outermost surface of rib 30 has an extended diameter 42 measured from central axis 26 that is greater than casing outer diameter 40 of casing joint 28. In both the retracted position and the extended position, the radially innermost surface of rib 30 has a rib inner diameter 44 that is substantially equal to casing inner diameter 46. In this disclosure, the term "substantially" when used to compare measurements means that the value of a first measurement is within ten percent of the value of the second measurement.

When using a swellable material for rib 30, rib 30 can be in a retracted position when delivering casing string 18 into wellbore 20 so that casing string 18 has a maximum outer diameter that is substantially casing outer diameter 40. After reaching a desired final position, or reaching a position where centralization of casing string 18 is otherwise desired, sellable material of rib 30 can be moved to the extended position so that rib 30 extends radially outward from casing string 18.

In an example of operation, during completion of a subterranean well a casing string can be delivered into the subterranean well, the casing string being an elongated tubular member formed of successive casing joints and having a central axis. The operation of delivering the casing string into the subterranean well can be a non-rotational operation. That is, the casing joints can be delivered into the subterranean well without rotating the casing joints. Instead, the casing string can be delivered into the subterranean well by movement that is generally only in a direction along the axis of the subterranean well. The casing string can have a plurality of elongated ribs that are secured to the casing string. The ribs are spaced circumferentially around an outer diameter of the casing string and extend axially from a downhole end of a casing joint to an uphole end of a casing joint. The ribs can help to centralize the casing string within the bore of the subterranean well. The ribs can include bearings for reducing the friction between the casing and the interior wall of the subterranean well during movement of the casing within the subterranean well.

As disclosed herein, embodiments of the disclosure provide systems and methods for improved casing centralization and stand-off, allowing for a uniform primary cement bond with the casing. Embodiments of the disclosure described herein, therefore, are well adapted to carry out the objects and attain the ends and advantages mentioned, as well as others inherent therein. While embodiments of the disclosure has been given for purposes of disclosure, numerous changes exist in the details of procedures for accomplishing the desired results. These and other similar modifications will readily suggest themselves to those skilled in the art, and are intended to be encompassed within the present disclosure and the scope of the appended claims.

What is claimed is:

1. A system for completing a subterranean well, the system including:

a casing string, the casing string being an elongated tubular member formed of successive casing joints and having a central axis;

a plurality of ribs secured to the casing string, the ribs being elongated members spaced circumferentially around an outer diameter of the casing string; where the ribs extend axially from a downhole end of a casing joint to an uphole end of the casing joint;

each of the plurality of ribs include a rod member and bearings located around a portion of an outer diameter of the rod member; and the rod member is welded directly to the outer diameter of the casing string.

2. The system of claim 1, where the ribs include a swellable material.

3. The system of claim 1, where the ribs include an elastic material.

4. A system for completing a subterranean well, the system including:

a casing string, the casing string being an elongated tubular member formed of successive casing joints and having a central axis, the casing string extending into the subterranean well;

a plurality of ribs secured to the casing string, the ribs being elongated members spaced circumferentially around an outer diameter of the casing string; where the ribs extend axially from a downhole end of a casing joint to an uphole end of the casing joint; and the ribs are positionable radially outward from the casing string to center the casing string within the subterranean well; where the ribs include a swellable material.

5. The system of claim 4, where each of the plurality of ribs include a rod member and bearings located around a portion of an outer diameter of the rod member.

6. The system of claim 4, where each of the plurality of ribs includes a wing member secured to the casing joint and extending radially outward, and a rod member located at a radially outward end of the wing member.

7. The system of claim 4, where each of the plurality of ribs is moveable between a retracted position and an extended position, where in the retracted position a radially outermost surface of the rib has a retracted diameter measured from the central axis that is substantially equal to an outer diameter of the casing joint, and where in the extended position the radially outermost surface of the rib has an extended diameter measured from the central axis that is greater than the outer diameter of the casing joint.

8. The system of claim 4, where the ribs include an elastic material.

9. A method for completing a subterranean well, the method including:

delivering a casing string into the subterranean well, the casing string being an elongated tubular member formed of successive casing joints and having a central axis;

providing a plurality of ribs that are secured to the casing string, the ribs being elongated members spaced circumferentially around an outer diameter of the casing string, where the ribs extend axially from a downhole end of a casing joint to an uphole end of the casing joint; where each of the plurality of ribs include a rod member and the method further includes locating bearings around a portion of an outer diameter of the rod member, and welding the rod member directly to the outer diameter of the casing string.

10. The method of claim 9, where each of the plurality of ribs includes a wing member, the method further including securing the wing member to the casing joint, where the rod member is located at a radially outward end of the wing member.

11. The method of claim 9, further including moving each of the plurality of ribs between a retracted position and an extended position, where in the retracted position a radially outermost surface of the rib has a retracted diameter measured from the central axis that is substantially equal to an outer diameter of the casing joint.

12. The method of claim 11, where in the extended position the radially outermost surface of the rib has an extended diameter measured from the central axis that is greater than the outer diameter of the casing joint.

13. A system for completing a subterranean well, the system including:

a casing string, the casing string being an elongated tubular member formed of successive casing joints and having a central axis;

a plurality of ribs secured to the casing string, the ribs being elongated members spaced circumferentially around an outer diameter of the casing string; where the ribs extend axially from a downhole end of a casing joint to an uphole end of the casing joint;

each of the plurality of ribs is moveable between a retracted position and an extended position, where in the retracted position a radially outermost surface of the rib has a retracted diameter measured from the central axis that is substantially equal to an outer diameter of the casing joint; and the ribs include a swellable material.

14. The system of claim 13, where in the extended position the radially outermost surface of the rib has an extended diameter measured from the central axis that is greater than the outer diameter of the casing joint.

15. A system for completing a subterranean well, the system including:

a casing string, the casing string being an elongated tubular member formed of successive casing joints and having a central axis;

a plurality of ribs secured to the casing string, the ribs being elongated members spaced circumferentially around an outer diameter of the casing string; where the ribs extend axially from a downhole end of a casing joint to an uphole end of the casing joint; and the ribs include an elastic material.

16. The system of claim 15, where the ribs are positionable radially outward from the casing string to center the casing string within the subterranean well.

* * * * *